US009410380B2

(12) United States Patent
Rutter et al.

(10) Patent No.: US 9,410,380 B2
(45) Date of Patent: Aug. 9, 2016

(54) SYSTEMS AND METHODS FOR PROVIDING FIBER OPTICS IN DOWNHOLE EQUIPMENT

(71) Applicant: Baker Hughes Incorporated, Houston, TX (US)

(72) Inventors: Risa Rutter, Claremore, OK (US); Ketankumar K. Sheth, Tulsa, OK (US); Suresha R. O'Bryan, Joplin, MO (US)

(73) Assignee: Baker Hughes Incorporated, Houston, TX (US)

( * ) Notice: Subject to any disclaimer, the term of this patent is extended or adjusted under 35 U.S.C. 154(b) by 548 days.

(21) Appl. No.: 13/875,648

(22) Filed: May 2, 2013

(65) Prior Publication Data

US 2014/0326466 A1 Nov. 6, 2014

(51) Int. Cl.

| | |
|---|---|
| ***E21B 17/20*** | (2006.01) |
| ***E21B 17/02*** | (2006.01) |
| ***E21B 47/00*** | (2012.01) |

(52) U.S. Cl.

CPC ..... *E21B 17/023* (2013.01); *E21B 47/0007* (2013.01)

(58) Field of Classification Search

CPC . E21B 47/123; E21B 17/023; E21B 17/1035; E21B 17/206; G02B 6/3816; G02B 6/38

See application file for complete search history.

(56) References Cited

U.S. PATENT DOCUMENTS

| | | | | | |
|---|---|---|---|---|---|
| 4,483,584 | A * | 11/1984 | Gresty | G02B 6/25 | 385/64 |
| 4,756,595 | A * | 7/1988 | Braun | G02B 6/3816 | 385/138 |
| 4,887,883 | A * | 12/1989 | Darbut | G02B 6/3816 | 385/58 |
| 5,892,860 | A * | 4/1999 | Maron | G01D 5/35383 | 374/E5.034 |
| 5,947,198 | A * | 9/1999 | McKee | E21B 17/023 | 166/377 |
| 6,571,046 | B1 * | 5/2003 | Hickey | E21B 17/003 | 385/134 |
| 6,888,124 | B1 | 5/2005 | Smith | | |
| 7,208,855 | B1 * | 4/2007 | Floyd | E21B 43/128 | 166/66.4 |
| 7,740,064 | B2 | 6/2010 | McCoy et al. | | |
| 7,798,212 | B2 * | 9/2010 | Bolze | E21B 17/02 | 166/242.1 |
| 8,523,454 | B2 * | 9/2013 | Ringgenberg | G02B 6/2558 | 385/53 |
| 8,752,635 | B2 * | 6/2014 | Wang | E21B 17/026 | 166/242.6 |
| 8,982,354 | B2 * | 3/2015 | O'Bryan | G01M 15/00 | 356/446 |
| 2002/0014340 | A1 * | 2/2002 | Johnson | E21B 17/00 | 166/380 |
| 2003/0081917 | A1 * | 5/2003 | Bussear | E21B 47/123 | 385/101 |
| 2012/0170613 | A1 * | 7/2012 | Ringgenberg | G02B 6/2558 | 374/161 |
| 2014/0326466 | A1 * | 11/2014 | Rutter | E21B 17/023 | 166/378 |

* cited by examiner

*Primary Examiner* — Daniel P Stephenson

(74) *Attorney, Agent, or Firm* — Law Offices of Mark L. Berrier

(57) ABSTRACT

Systems and methods for installing an optical fiber in a downhole equipment system having multiple components that are installed in the field. Components such as sections of an ESP motor are assembled, forming a continuous sealed conduit that extends through the components. The conduit is sealed to prevent potentially damaging fluids from leaking into the conduit. After the conduit through the components is formed, an optical fiber is inserted into the conduit so that the fiber spans the connections between the components. The optical fiber may incorporate multiple sensors (e.g., fiber Bragg gratings) that can sense parameters such as temperature at multiple points in the different components. The passageways through the different components may have different diameters or tapered/chamfered edges to facilitate insertion of the optical fiber in the conduit.

7 Claims, 5 Drawing Sheets

SYSTEMS AND METHODS FOR PROVIDING FIBER OPTICS IN DOWNHOLE EQUIPMENT

BACKGROUND

1. Field of the Invention

The invention relates generally to monitoring downhole equipment, and more specifically to systems and methods for installing optical fibers in downhole equipment without the need for splicing the optical fibers between different sections of the equipment.

2. Related Art

Oil production often requires the use of artificial lift systems to recover oil and other well fluids from wells. These artificial lift systems may include, for example, electric submersible pump (ESP) systems and subsea boosting systems. These systems are typically very expensive to install and operate. A subsea lift system may, for example, cost tens of millions of dollars to install and hundreds of thousands of dollars each day to operate. The costs associated with failures and downtime in these systems are also very high.

Because of the high cost of an artificial lift system such as may be installed in subsea applications, it is very important to take steps to ensure that it is as reliable as possible and has the longest possible operational life. One of the things that can be done to improve reliability is to monitor various parameters associated with the system in order to determine the "health" of the system. These parameters may include such things as temperature, pressure, vibration, fluid flow, fluid viscosity, voltage, current, and many others.

If the monitored parameters remain within desired operating ranges (a "green" zone), the system may continue to operate without any changes. If the monitored parameters fall outside the desired operating ranges, but are still within acceptable limits (a "yellow" zone), it may be necessary to adjust the operation of the system in some manner. This may include modifying control signals, updating operating parameters within the downhole equipment, and so on. These adjustments are intended to move the operation of the system (as indicated by the monitored parameters) back into the green operating zone. If the adjustments do not cause the parameters to return to the desired operating ranges, this may indicate that it is necessary to perform repair or maintenance on the system. If the monitored parameters fall outside the range of acceptable values (a "red" zone), it may be necessary to discontinue operation of the system, and possibly repair or replace one or more system components.

One of the key parameters that may be monitored is the temperature of the system components that are positioned downhole within a well. In some applications, the temperature can be as high as 600° F. High temperatures can be very hard on components such as motor bearings, and even materials such as electrical insulation, which may begin to break down and lose its electrically insulating properties. Conventionally, thermal sensors such as thermocouples were designed into equipment such as ESP motors to provide information on the temperature of the equipment. A thermocouple, however, can only monitor the temperature at a single point, so multiple thermocouples would be required to provide temperature information from different points within the equipment.

More recently, optical fibers that incorporate multiple sensors (fiber Bragg gratings) have been incorporated into the designs of equipment such as ESP motors in order to provide temperature information from multiple points within the motors. These types of sensors also have some drawbacks, however. For instance, in some applications, it may be necessary for an ESP motor to be several hundred feet long in order to generate the required horsepower to drive the associated pump. Because it would be very difficult to transport a motor of this size from the factory to the field where it will be installed, it is typically necessary to construct the motor in sections, each of which is less than 40 feet in length. If fiber optic sensors are incorporated into the motor sections, means must be provided to splice together the optical fibers of adjacent motor sections in the field when the motor is assembled and installed in the well. Currently available means to achieve the splices are expensive, slow and difficult to assemble, and too large to be accommodated in downhole motors.

It would therefore be desirable to provide means to facilitate the use of fiber optics in downhole equipment such as multi-section ESP motors which reduce or overcome one or more of the problems above.

SUMMARY OF THE INVENTION

This disclosure is directed to systems and methods for installing an optical fiber in a downhole equipment system having multiple components that are installed in the field. The components are assembled to form a continuous sealed conduit that extends through multiple ones of the components (e.g., motor sections). The conduit is sealed to prevent potentially damaging fluids from leaking into the conduit. After the conduit through the components is formed, an optical fiber is inserted into the conduit so that the fiber spans the connections between the components. Large, costly and time-consuming fiber optic splices between the different components are thereby avoided.

The components in which the optical fiber is installed may be, for example, sections of an ESP motor, a pump section, a seal, or some other type of component. A tubular connector may be used to couple the passageways of the different components to form the continuous conduit. The tubular connectors may be designed to extend upward, above the face of a lower motor section in order to allow the motor section to be filled with oil while preventing oil from entering the conduit. The passageways in the different components may have different diameters, or may have tapered openings to prevent the end of the optical fiber from catching on the passageway openings when the optical fiber is inserted into the conduit. The optical fiber may be unspliced, and may incorporate embedded sensors, such as fiber Bragg gratings.

Alternative embodiments may include methods for installing optical fibers in downhole equipment. In one embodiment, multiple system components (e.g., motor sections) are provided, where each of the components has a passageway through it to accommodate an optical fiber. A tubular connector is installed at the top of a lower component at the upper end of the passageway through this component. The tubular connector is initially capped to seal off the conduit that includes the passageway. The lower component is filled with oil. After the lower component has been filled with oil, the cap is removed from the tubular connector and an upper component is installed on the top of it. The tubular connector couples the passageways of the upper and lower components to form a single, sealed conduit through both components. An optical fiber is then inserted into the conduit so that it is positioned within both of the components.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
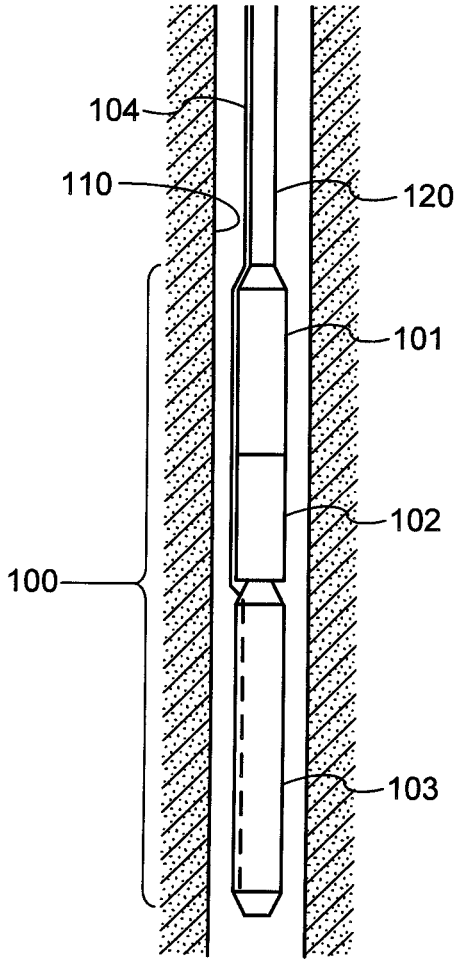
FIG. 1 is a diagram illustrating an ESP system installed in a well in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

The increasing costs of installing, maintaining and operating artificial lift systems is increasing the importance of monitoring conditions relating to operation of these systems. One of the operating conditions that is very important in assessing the health of an artificial lift system is the temperature of the system. The operating temperature of the can be measured in various ways. For instance, temperatures at multiple points within the system can be conveniently measured using an optical fiber having embedded sensors. One of the difficulties of using fiber optic sensors, however, is that artificial lift systems often have multiple components that have to be assembled in the field (such as sections of an ESP motor), which conventionally required optical fibers in the different components to be spliced together. These splices were typically time consuming, expensive, and too large for the small diameters of downhole equipment.

The present systems and methods reduce or minimize these problems by providing a means to form a conduit through the various system components and then installing a continuous optical fiber in the conduit. The conduit can be formed in a relatively simple and straightforward manner, and the use of a continuous fiber that is installed in the conduit after the system components (e.g., motor sections) are assembled eliminates the need for splices to connect different sections of optical fiber between different system components. The conduit is sealed to prevent hydrogen-containing fluids such as motor oil and well fluid from contacting the optical fiber and degrading the fiber's performance. The conduit may also include features that facilitate installation of the optical fiber therein.

Referring to FIG. 1, a diagram illustrating an ESP system installed in a well is shown. ESP system 100 is installed within the bore 110 of a well. The well may be a subsea well or a surface well. In this embodiment, ESP system 100 is suspended in the well from production tubing 120. ESP system 100 includes a pump 101, a seal 102 and a motor 103. A fiber optic cable 104 couples surface equipment (not shown) to ESP system 100. Fiber optic cable 104 includes an optical fiber and a protective housing that prevents exposure of the optical fiber to well fluids. In this embodiment, fiber optic cable 104 has a sealed connection to the housing of motor 103 and the optical fiber extends into motor 103 so that it can be used to monitor conditions in the motor, such as its temperature. ("Sealed", as used herein, refers to the sealing of the passageway connections to prevent potentially damaging fluids from entering the passageways and coming into contact with the optical fiber.)

In the embodiment of FIG. 1, motor 103 is assembled from multiple, separate motor sections. Each of the motor sections is up to about 35 feet in length, which allows them to be transported in standard 40-foot shipping containers. Each of the motor sections has a tube that extends through it to accommodate an optical fiber having embedded sensors. A coupling is installed between each of the motor sections to provide a sealed connection between the tubes in the different sections, thereby forming a continuous, sealed, protective conduit that extends through the motor. Fiber optic cable 104 (which contains one or more optical fibers) is coupled to the end of this conduit via a sealed connection. A port may be provided at one end of the conduit to provide means to couple the fiber optic cable to the conduit, and means to introduce the optical fiber(s) of the cable into the conduit. The optical fiber from the cable extends into the conduit within the motor or other system components to enable sensing of the temperature or other parameters at multiple points in the motor or other system components. The optical fiber may also be used to communicate information through the system components. The optical fiber is inserted into the conduit after the motor sections and/or other system components are connected, so no splices between system components are required. The optical fiber itself may be spliced before it is inserted into the conduit.

It should be noted that, while FIG. 1 depicts an ESP system in which an optical fiber is installed in the motor (through each of the motor's different sections), alternative embodiments may form a conduit through any type of system component, including motors, pumps, seals, gauges, and the like. The conduit may span all of the components, or selected ones of the components.

Figure 2:
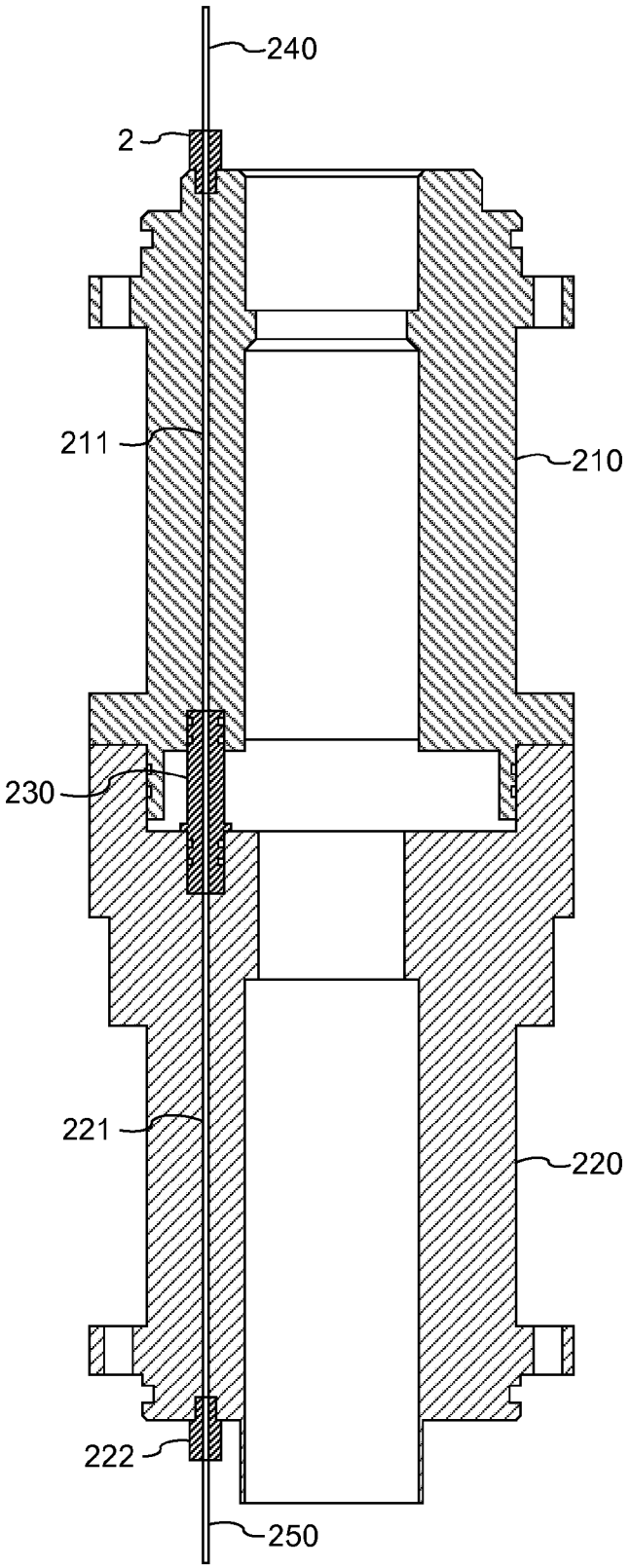
FIG. 2 is a diagram illustrating the coupling of two of the motor sections in accordance with one embodiment.

Referring to FIG. 2, a diagram illustrating the coupling of two of the motor sections in more detail is shown. Each of the motor sections has a body that houses respective sections of the stator and rotor. At the upper end of the body is a motor head, and at the lower end of the body is a motor base. FIG. 2 depicts the base 210 of an upper motor section coupled to the head 220 of a lower motor section. The remainder of each motor section is not shown. For purposes of clarity, the details of the electrical and mechanical connections are not described herein.

The upper motor section has a tube 240 that extends through it. A lower end of tube 240 is connected to a passageway 211 that extends through motor base 210. Leak proof connector 212 couples tube 240 to passageway 211 and prevents oil in the upper motor section from leaking into the tube or passageway. Motor head 220 likewise has a passageway 221 that extends through it. A tube 250 that extends through the lower motor section is connected to passageway 221 by another leak proof connector 222. Leak proof connector 222 prevents oil in the lower motor section from leaking into tube 250 or passageway 221.

A tubular connector 230 is installed between motor base 210 and motor head 220 to connect passageway 211 to passageway 221. Tubular connector 230 is a rigid tubular structure that bridges the gap between motor base 210 and motor head 220. As will be described in more detail below, tubular connector 230 extends above the top of motor head 220 in order to facilitate assembly of the motor. The ends of tubular connector 230 are sealed against motor base 210 and motor head 220 to prevent motor oil from leaking into passageways 211 and 221, or tubes 240 and 250. As will be described in more detail below, an optical fiber is positioned in the conduit formed by the passageways.

Figure 3:
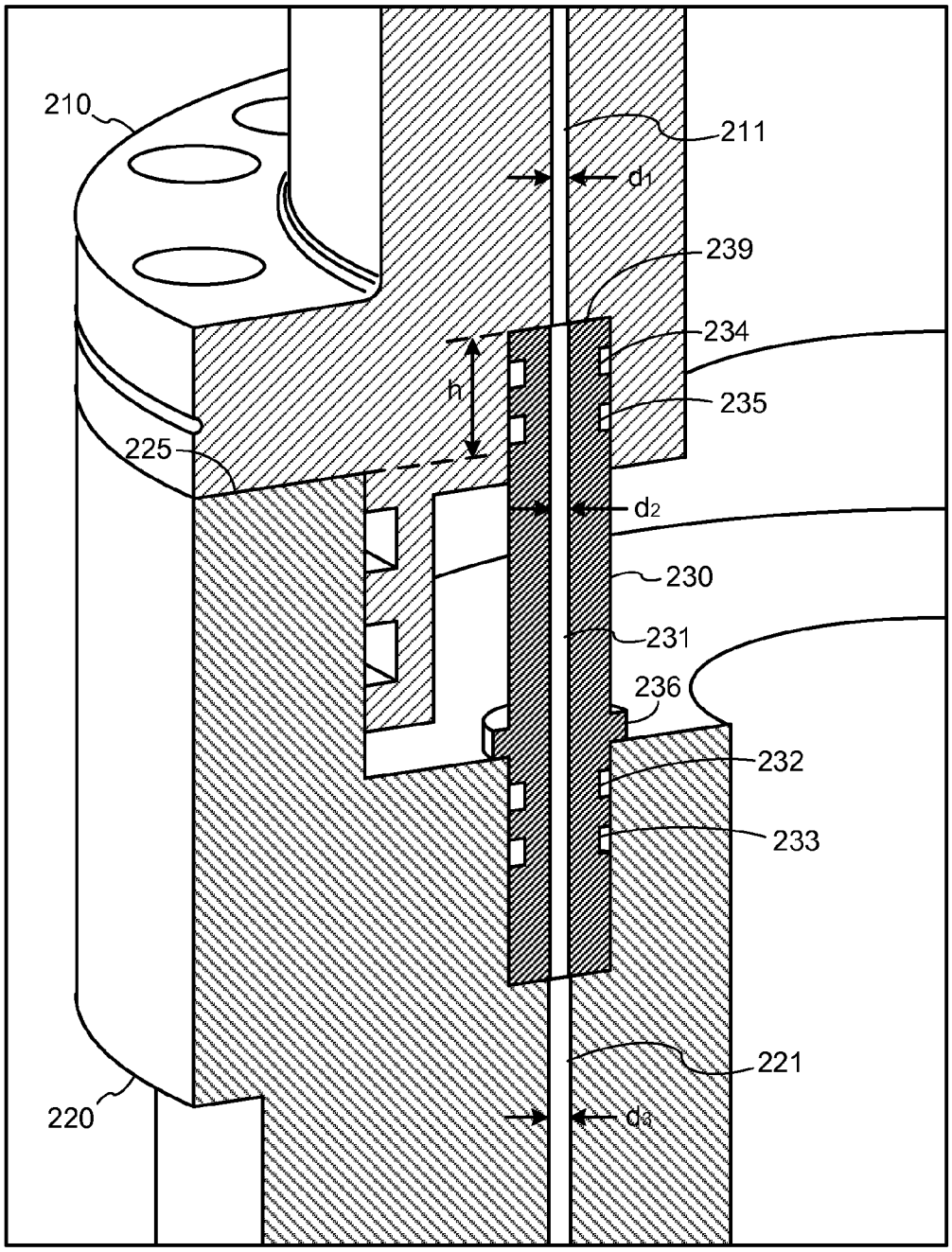
FIG. 3 is a detailed view of a coupling between a motor base and motor head in accordance with one embodiment.

Referring to FIG. 3, a more detailed view of the coupling between the motor base and motor head is shown. In particular, a close-up view of the interface between motor base 210 and motor head 220 is provided. It can be seen in this figure that a lower end of tubular connector 230 fits into a recess in motor head 220. In this embodiment, tubular connector 230 has a shoulder 236 that limits the depth to which the tubular connector can extend into the recess. A pair of o-ring seats 232 and 233 are provided to accommodate corresponding o-rings. This ensures a seal between tubular connector 230 and motor head 220, so that oil contained in the motor does not enter the conduit formed by passageways 211, 221 and 231.

The upper end of tubular connector 230 fits into a recess in motor base 210, which is connected (e.g., bolted) to motor head 220. Tubular connector 230 spans the gap between motor base 210 and motor head 220, so that a continuous conduit is formed. A pair of o-ring seats 234 and 235 are provided to accommodate corresponding o-rings, which ensures a seal between tubular connector 230 and motor base 210. As noted above, this prevents oil contained in the motor from entering the conduit formed by the passageways through the motor base, connector and motor head. An optical fiber is positioned in the conduit formed by passageways 211, 231 and 221. The optical fiber is not explicitly depicted in the figure.

As shown in FIG. 3, passageway 211 in motor base 211 has a diameter $d_1$.

Figure 4A:
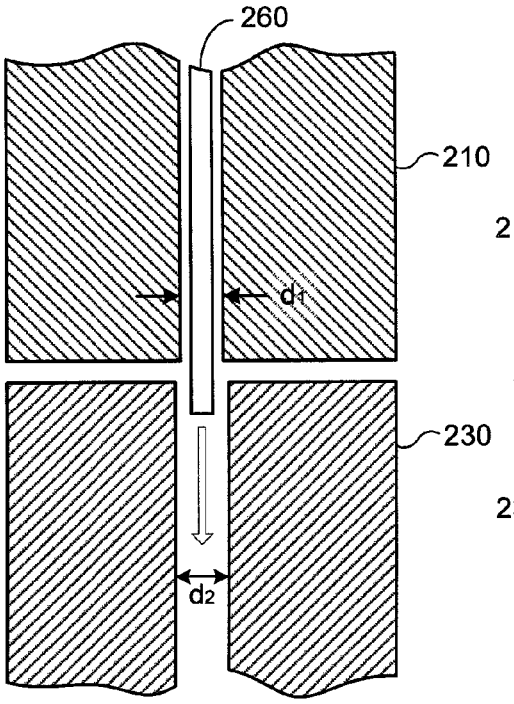
FIGS. 4A and 4B are diagrams illustrating insertion of an optical fiber through passageways that have different-diameters (4A) and chamfered/tapered edges (4B).

Passageway 231 in connector 230 has a diameter $d_2$, and passageway 221 in motor head 220 has a diameter $d_3$. Passageway 211 has the smallest diameter ($d_1$), while passageway 221 has the largest diameter ($d_3$). In other words, $d_1<d_2<d_3$. The different diameters of the passageways are designed to facilitate installation of an optical fiber in the conduit formed by the passageways. Since each successive diameter (from top to bottom) has a slightly larger diameter, an optical fiber that has been successfully inserted through an upper passageway should easily pass through the following (lower) passageway, which has a slightly larger diameter, with no difficulty. The insertion of the optical fiber through different-diameter passageways is illustrated in FIG. 4A.

Figure 4B:
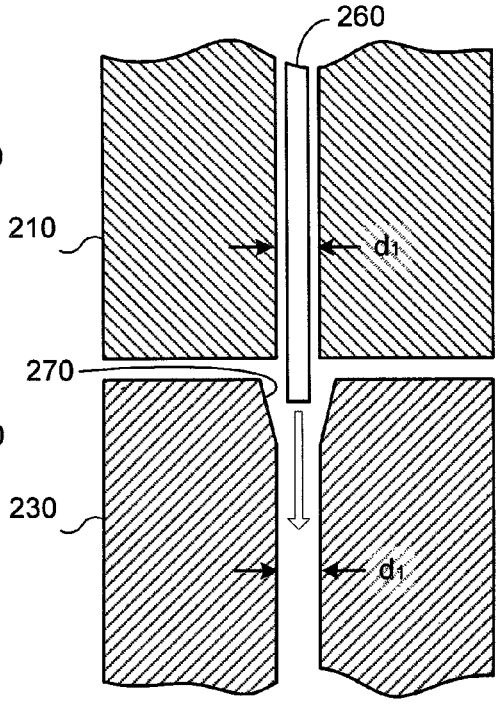

It should be noted that the use of different-diameter passageways is not necessary in all embodiments. In some alternative embodiments, the passageways may all have the same diameter. It may be desirable in these embodiments to chamfer or taper the upper ends of the passageways so that the opening of the passageway is wider than the body of the passageway. This helps prevent the optical fiber from getting caught on the edge of the opening to the lower passageway. Chamfered/tapered edges 270 on connector 230 are illustrated in FIG. 4B. Some embodiments may utilize both different-diameter passageways and tapered/chamfered passageway openings.

It can be seen in FIGS. 2 and 3 that tubular connector 230 is long enough that its upper end (239) extends upward beyond the upper end (225) of motor head 220 by a height h. This allows the conduit through tubular connector 230 to be accessible after the lower motor section is filled with oil during the assembly of the motor. Tubular connector 230 is normally capped when the lower motor section is filled with oil in order to prevent the oil from entering the passageway through the connector. After the lower motor section is filled with oil, the cap can be removed, so that the upper motor section can be installed. Tubular connector 230 extends between the upper and lower motor sections when assembled, forming a sealed connection between passageways 211, 231 and 221.

Figure 5:
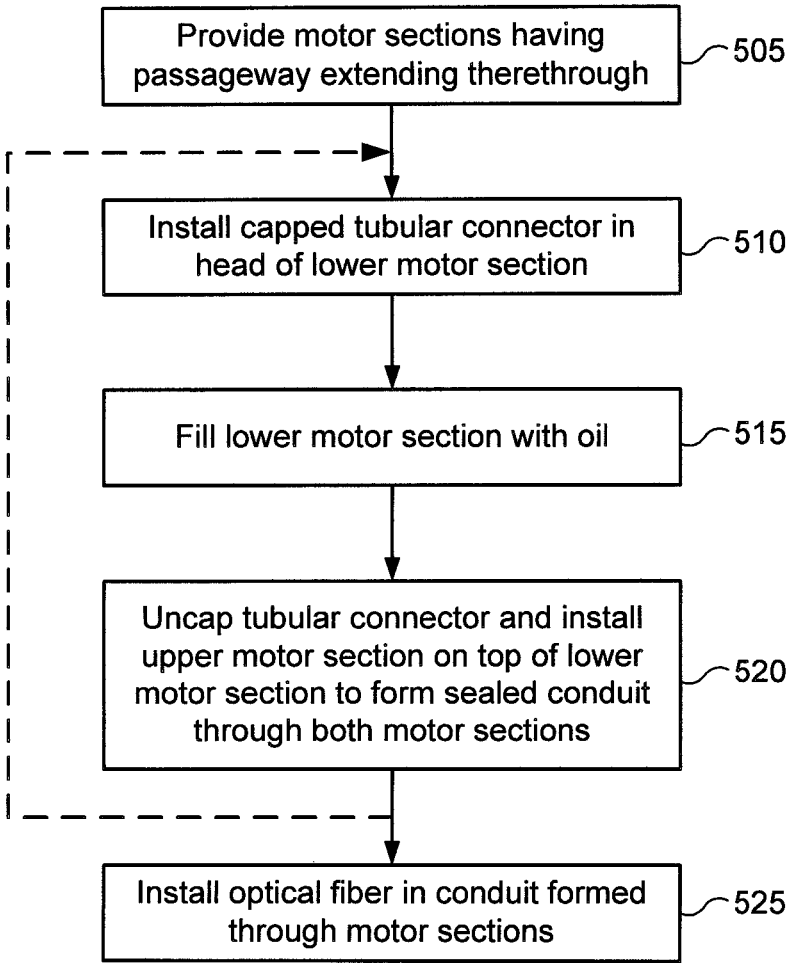
FIG. 5 is a flow diagram illustrating an exemplary method for installing an optical fiber in an ESP motor having multiple sections.

Embodiments of the invention may also include methods for installing optical fibers in downhole equipment. Referring to FIG. 5, a flow diagram illustrating an exemplary method for installing an optical fiber in an ESP motor having multiple sections is shown. For purposes of clarity, this exemplary method will be described with respect to a two-section motor, although it can be applied to motors having more than two sections.

The first step in this method is providing multiple (e.g., two) motor sections, where each of the motor sections has a passageway through it to accommodate an optical fiber therein (step 505). It is assumed that the passageway through the lowest section of the motor is terminated or capped at its lower end. A tubular connector is installed at the top of the lower motor section, so that the passageway through the lower motor section and the tubular connector are coupled to form a continuous conduit (step 510). The tubular connector is initially capped to seal off this conduit. The installation of the tubular connector may be performed at the factory or in the field. The subsequent steps of the method are performed in the field (at a well location).

The lower motor section is then filled with oil (step 515). The cap on the tubular connector prevents the oil from entering the conduit, where it could later contact the optical fiber and degrade its sensing and transmission characteristics. The upper end of the tubular connector extends above the upper end of the lower motor section so that after the lower motor section has been filled with oil, the cap can be removed without allowing oil to enter the conduit. When the lower motor section is filled with oil, the cap is removed from the tubular connector and the upper motor section is installed on the top of the lower motor section (step 520). When the two motor sections are assembled, the tubular connector couples the passageways in the motor sections to form a single, sealed conduit through both motor sections.

The upper motor section has a port at its upper end that allows access to the conduit through the assembled motor sections. An optical fiber is inserted into the conduit (step 525). The continuous sealed conduit through the motor sections allows a single optical fiber to be installed in the different motor sections without the need to splice together different segments of optical fibers that are permanently installed in the different motor sections. Likewise, this method (and the corresponding apparatus) avoids the size restrictions, cost and installation time associated with conventional fiber optic splices.

While specific embodiments of the present invention have been described Pressure differential above, alternative embodiments may vary from the described embodiments in a number of ways. For example, while the embodiment of FIGS. 1-3 provides a conduit through which an optical fiber can be installed in multiple sections of an ESP motor, other embodiments may use the same means to install an optical fiber in other downhole system components. These means can be implemented in two or more such components. The installed optical fiber (or fibers) can be used to provide an optical communication channel and/or sensing means.

Although the foregoing embodiments utilize a separate tubular connector to couple the passageways of the different motor sections, alternative embodiments may incorporate this connector into one of the motor sections (e.g., into the motor head). Further, while the foregoing embodiments describe a single optical fiber which is inserted into the conduit, alternative embodiments may have more than one optical fiber inserted into the conduit. Other variations will also be apparent to those of skill in the art.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A downhole equipment system comprising:

a plurality of field-assembled downhole system components, wherein each of the components has a passageway therein sized to accommodate an optical fiber, wherein when the components are assembled, the passageways of the components form a single sealed conduit that extends through the plurality of components, wherein the conduit has a port that is capable of being sealingly coupled to a fiber optic cable, and wherein hydrogen-containing fluids are prevented from contacting the optical fiber in the conduit; and an optical fiber which extends through the port and into the conduit, wherein the optical fiber occupies at least a portion of each of the passageways of the plurality of components, wherein the components include at least an upper component and a lower component, wherein the passageway of the lower component has a greater diameter than the passageway of the upper component.

2. The system of claim 1, wherein the components include at least an upper component and a lower component, wherein a tubular connector is coupled between the upper component and the lower component, wherein the passageway of the lower component has a greater diameter than a passageway through the tubular connector, and wherein the passageway through the tubular connector has a greater diameter than the passageway of the upper component.

3. A method comprising:

providing a plurality of field-assembled downhole system components, wherein each of the components has a passageway therein sized to accommodate an optical fiber;

field-assembling the components and coupling the passageways of the components to form a single sealed conduit that extends through at least two of the components; and inserting an optical fiber into the conduit, wherein the inserted optical fiber occupies at least a portion of each of the passageways of the at least two components, wherein the at least two components comprise sections of a electric submersible pump motor, wherein for at least a lower one of the motor sections, the method further comprises coupling a tubular connector to an upper end of the corresponding passageway through the lower motor section, wherein an upper end of the tubular connector extends above an upper end of the lower motor section, and wherein field-assembling the motor sections comprises temporarily sealing an upper end of the tubular connector of the lower motor section, filling the lower motor section with oil, unsealing the tubular connector, and installing an upper one of the motor sections on the lower motor section, thereby forming a sealed conduit through the upper and lower motor sections and the tubular connector.

4. A method comprising:

providing a plurality of field-assembled downhole system components, wherein each of the components has a passageway therein sized to accommodate an optical fiber;

field-assembling the components and coupling the passageways of the components to form a single sealed conduit that extends through at least two of the components; and inserting an optical fiber into the conduit, wherein the inserted optical fiber occupies at least a portion of each of the passageways of the at least two components, wherein the components include at least an upper component and a lower component, wherein the passageway of the lower component has a greater diameter than the passageway of the upper component.

5. The method of claim 4, wherein the components include at least an upper component and a lower component, wherein a tubular connector is coupled between the upper component and the lower component, wherein the passageway of the lower component has a greater diameter than a passageway through the tubular connector, and wherein the passageway through the tubular connector has a greater diameter than the passageway of the upper component.

6. A method comprising:

providing a plurality of field-assembled downhole system components, wherein each of the components has a passageway therein sized to accommodate an optical fiber;

field-assembling the components and coupling the passageways of the components to form a single sealed conduit that extends through at least two of the components; and inserting an optical fiber into the conduit, wherein the inserted optical fiber occupies at least a portion of each of the passageways of the at least two components;

wherein the components include at least an upper component and a lower component, wherein the passageway of the lower component has a first opening that has a greater diameter than the passageway of the upper component, wherein the components include at least an upper component and a lower component, wherein a tubular connector is coupled between the upper component and the lower component, wherein the first opening of the passageway of the lower component has a greater diameter than a passageway through the tubular connector, and wherein the passageway through the tubular connector has a second opening that has a greater diameter than the passageway of the upper component.

7. A method comprising:

providing a plurality of field-assembled downhole system components, wherein each of the components has a passageway therein sized to accommodate an optical fiber;

field-assembling the components and coupling the passageways of the components to form a single sealed conduit that extends through at least two of the components; and inserting an optical fiber into the conduit, wherein the inserted optical fiber occupies at least a portion of each of the passageways of the at least two components;

wherein the components include at least an upper component and a lower component, wherein the passageway of the lower component has a first opening that has a greater diameter than the passageway of the upper component;

wherein the plurality of downhole system components comprise sections of a electric submersible pump motor;

wherein field-assembling the motor sections comprises temporarily sealing an upper end of the tubular connector of the lower motor section, filling the lower motor section with oil, unsealing the tubular connector, and installing an upper one of the motor sections on the lower motor section, thereby forming a sealed conduit through the upper and lower motor sections and the tubular connector.

* * * * *